United States Patent [19]

Colucci

[11] Patent Number: 4,498,592

[45] Date of Patent: Feb. 12, 1985

[54] MAGAZINE DISPLAY RACK

[75] Inventor: James Colucci, Fountain Valley, Calif.

[73] Assignee: Design Wire Products, Inc., Los Angeles, Calif.

[21] Appl. No.: 574,078

[22] Filed: Jan. 26, 1984

[51] Int. Cl.[3] ..... A47F 5/01

[52] U.S. Cl. ..... 211/42; 40/10 R; 40/308; 211/48; 211/106; 211/181

[58] Field of Search ..... 211/42, 106, 50, 55, 211/56, 58, 45, 47, 99, 181, 48; 40/10 R, 308, 10 A, 10 B, 11 A, 16; 206/45.13; 220/19

[56] References Cited

U.S. PATENT DOCUMENTS

| | | | |
|---|---|---|---|
| 2,706,517 | 4/1955 | Dexter et al. | 211/50 X |
| 2,793,760 | 5/1957 | Zel et al. | 211/181 X |
| 3,302,797 | 2/1967 | Kolster | 211/55 |
| 3,918,588 | 11/1975 | Walser et al. | 211/181 X |
| 4,140,221 | 2/1979 | Garland | 211/58 |
| 4,245,834 | 1/1981 | Songer et al. | 211/50 X |

*Primary Examiner*—Robert W. Gibson, Jr.

*Attorney, Agent, or Firm*—Freilich, Hornbaker, Rosen & Fernandez

[57] ABSTRACT

A magazine display rack disclosed is comprised of a plurality of cages in a trough-like housing that may be secured on a display panel or wall. Each cage, which has a sheet or sheets in front to screen all of the magazine cover except its title and issue date, may be pivoted outwardly on the front edge of the trough-like housing to insert or remove a magazine through the open bottom of the cage. All magazine cages are ganged together by a heavy wire or rod so that in pivoting the cages to remove a magazine, all magazines must be held up in their cages. Any magazine not held up in its cage will slide along the bottom of the trough-like housing, until it engages the rear corner thereof. This helps prevent unauthorized removal of a magazine from its cage.

4 Claims, 7 Drawing Figures

MAGAZINE DISPLAY RACK

BACKGROUND OF THE INVENTION

This invention relates to a magazine display rack of the type in which only samples of magazines offered are displayed, and only the title portion of the magazine cover is in view.

A problem has developed in offering magazines published for the adult population in supermarkets, drugstores and general merchandise stores frequented by unsupervised children. In order to display the current issues of adult magazines in stock, without giving unsupervised children access, or adults who merely want to peruse but not buy the magazine, it is necessary to provide a display rack that secures the displayed magazines and permits the public to see only the title and issue date near the top of the cover.

SUMMARY OF THE INVENTION

In accordance with the invention, a plurality of magazine cages are provided, each capable of holding a single magazine for display with only its title in view through a window or slot in a screen across the front of the cage, and each capable of being pivoted outwardly about the front edge of a trough-like housing. Each cage is closed at its upper end and open at its lower end, where the "upper" and "lower" end designations are with reference to the magazine cage upright and with the lower end inside the trough-like housing while displaying a magazine in the upright position with only its title across its upper end in view. The magazine cage is pivoted outwardly to gain access to its lower end for the purpose of inserting or removing a magazine. All of the magazines are ganged by suitable means, such as a rod, so that all must pivot together. The depth of the trough is such that, while a cage is in the upright position, the magazine will be held up in the cage by the floor in the trough with the title of the magazine in the window of the cage screen. The dimension of the trough from front to rear is chosen so that the magazines in the cages will just clear the rear wall if held fully inserted in the cages while the cages are pivoted. A magazine allowed to fall out of its cage as the cages are pivoted will engage the rear wall of the trough to impede pivoting the cages further, thereby impeding the removal of magazines from the cages.

The novel features of the invention are set forth with particularity in the appended claims. The invention will best be understood from the following description when read in conjunction with the accompanying drawings.

DESCRIPTION OF PREFERRED EMBODIMENTS

Figure 1:
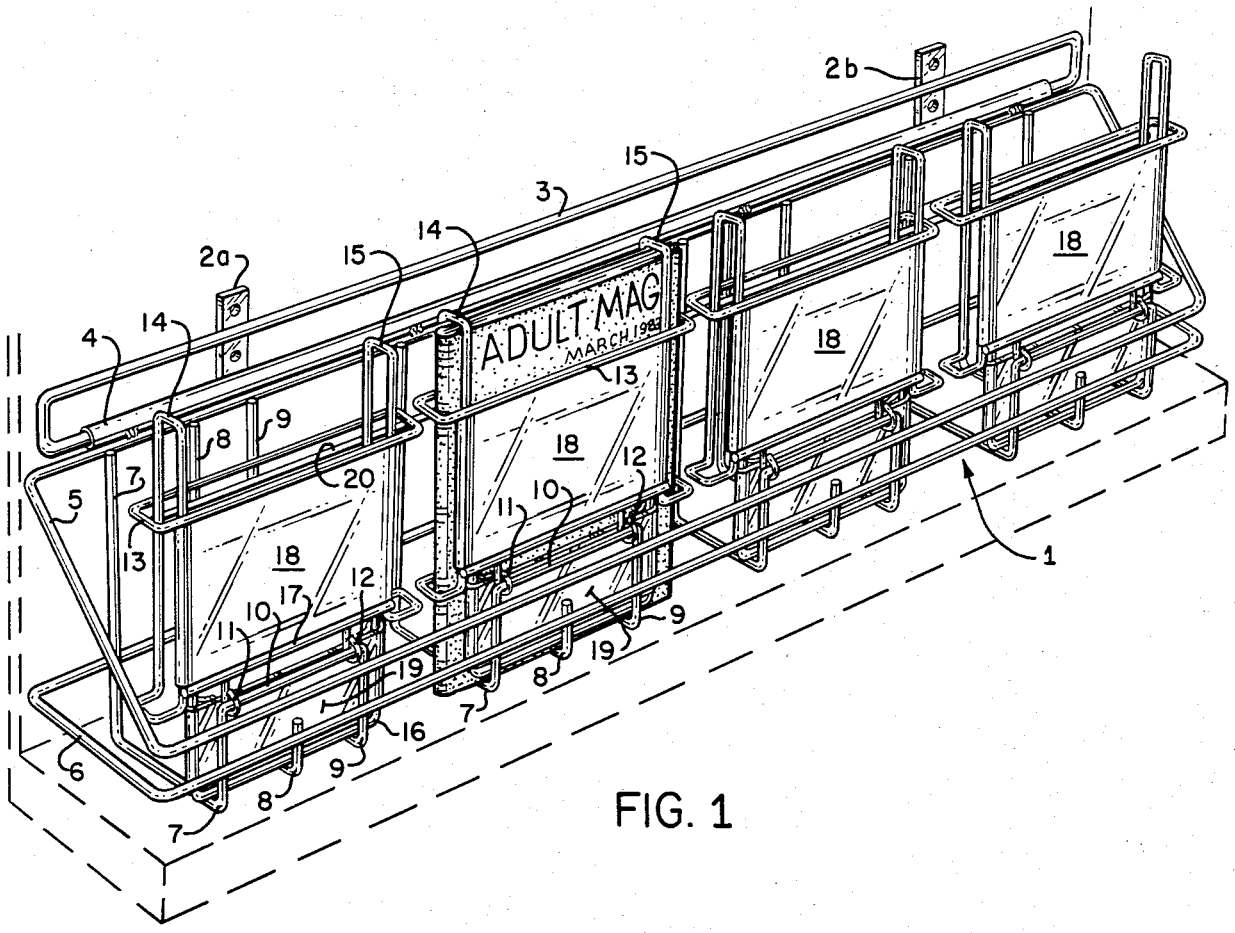
FIG. 1 is an isometric view of a magazine display rack having four magazine cages in accordance with the present invention.
Figure 2:
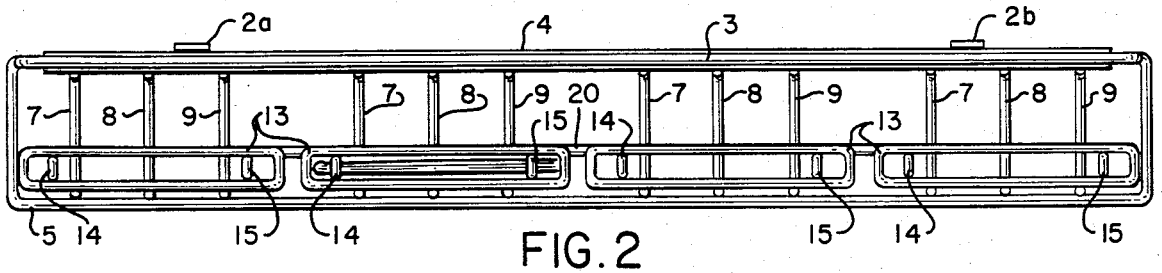
FIG. 2 is a plan view of the rack of FIG. 1.

A preferred embodiment of a magazine rack shown in the drawings is fabricated with stainless steel rods, or wire, bent into proper shapes and welded, or brazed, at every point where two wires cross. This technique for manufacturing display racks is widely known and practiced. Besides the many advantages in manufacturing, there are other advantages in using such wire display racks. A principal advantage is they cannot catch and hold debris, such as chewing gum wrappers that customers may want to discard while in the store. However, as will become evident from the following description, the present invention is not restricted to the use of wires to form a trough-like housing for a plurality of pivotal magazine cages; either or both may be made from other material such as sheet metal or plastic.

Referring to the drawings, and in particular FIG. 1, a trough-like housing 1 is secured by brackets 2*a* and 2*b* to a display panel (shown in dashed lines). Other figures show different views for a better understanding of this invention. A wire 3 welded to the brackets 2*a* and 2*b* is looped into a tube 4 at each end thereof, and the housing 1 is welded to the tube so that, in practice, the housing is hinged on the display panel to facilitate reaching space below it, such as for sweeping and dusting, or to facilitate reaching into a rack below it for loading.

The housing 1 is comprised of two loops 5 and 6. The upper loop 5 is in a plane that slopes downwardly from the tube 4, while the lower loop 6 is in a horizontal plane. The positions of these two loops are secured relative to each other in space by three vertical U-shaped wires at each magazine cage position, such as the U-shaped wires 7, 8 and 9 for the cage shown with a magazine in place. The vertical wire 7 and 9 extends downwardly from the rear of the wire loop 5 to a point below the wire loop 6, and from there horizontally to a point below and just inside the front of the loop 6, and then upwardly just inside the front of the loops 5 and 6. The center wire 8 is formed the same way, but may extend upwardly to just the loop 6 in front, as shown. The two wires 7 and 9 that do extend up to the loop 5 in front, are in fact formed from one continuous wire bent to provide a horizontal wire 10 between them from which the magazine cage is hinged using two wires 11 and 12 looped around the front horizontal wire 10.

The magazine cage is comprised of a horizontal closed wire loop 13 and two closed vertical loops 14 and 15. The lower ends of the vertical loops are bent outwardly (i.e., away from each other), as shown, to positions parallel to and in line with the ends of the closed loop 13. A U-shaped wire 16 that is in the upright position when the cage is upright, as shown in FIG. 1, has its sides extending from the front of the loop 13 downwardly along the front sides of the vertical loops 14 and 15. This U-shaped wire secures the loops 13, 14 and 15 in space relative to each other. An additional reinforcing wire 17 may be provided from the vertical loop 14 to the vertical loop 15. Each of the wires 11 and 12 used to hinge the cage on the horizontal wire 10 extends from the horizontal reinforcing wire 17 up to the inside of the loop 13.

Figure 3:
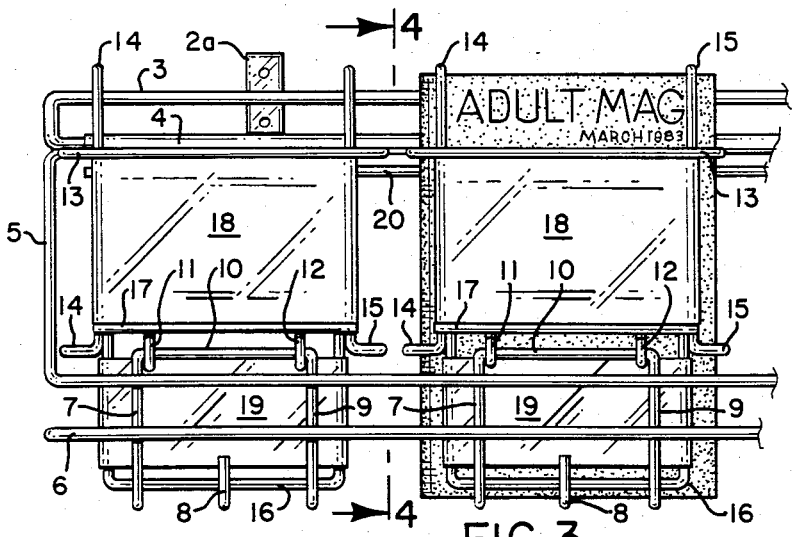
FIG. 3 is a front elevation of the left portion of the rack in FIG. 1.
Figure 4:
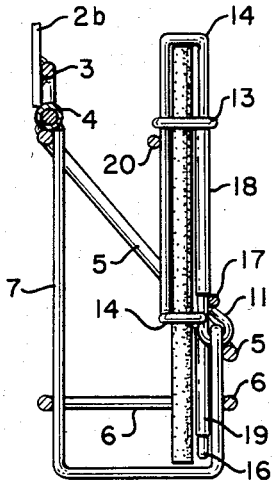
FIG. 4 is a sectional view taken along a line 4—4 in FIG. 3.

A metal or plastic sheet 18 is provided between the vertical loops 14 and 15 from the reinforcing wire 17 up to the loop 13 to screen the main portion of the magazine cover from the title of the magazine down. Another sheet 19 is provided below the reinforcing wire 17 between the sides of the U-shaped wire 16 to screen the lower portion of the magazine cover. Both sheets could be portions of a single sheet, provided the looped ends of the wires 11 and 12 are passed through the sheet to loop around the horizontal wire 10, although other means could be provided to hinge the cage on the horizontal wire, such as straps secured to the face of such a unitary sheet that passes over the horizontal reinforcing wire 17. The arrangement of the sheets 18 and 19 may be better appreciated from the front elevation shown in FIG. 3.

Figure 5:
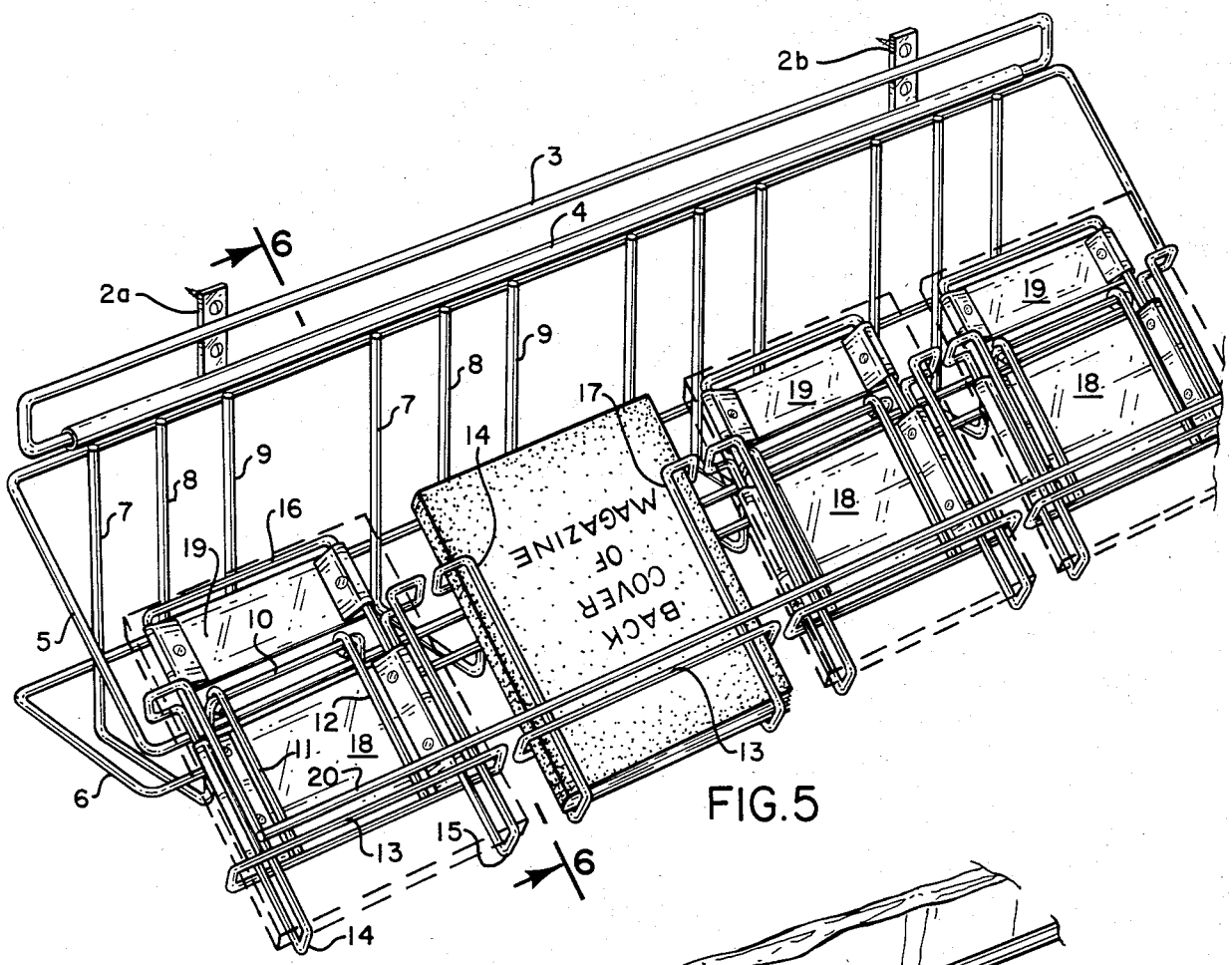
FIG. 5 is an isometric view of the rack of FIG. 1 with magazine cages pivoted outwardly to insert new magazines for display.
Figure 6:
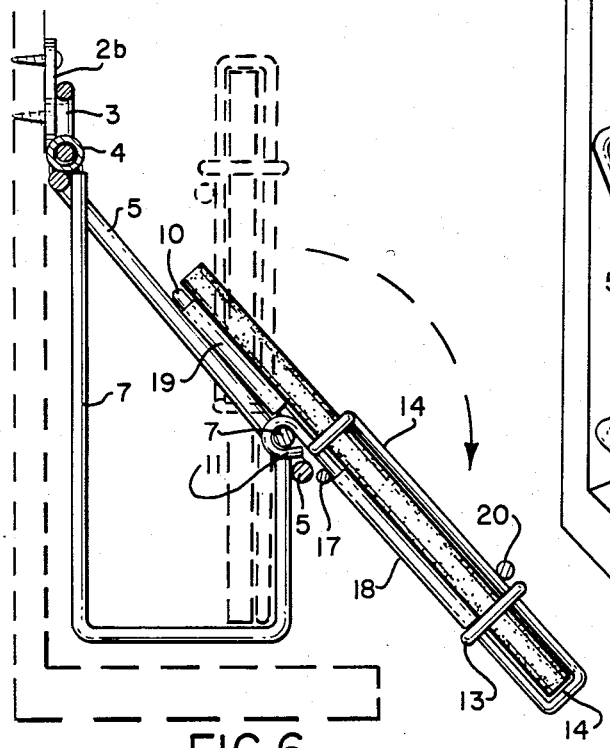
FIG. 6 is a sectional view taken along a line 6—6 in FIG. 5.
Figure 7:
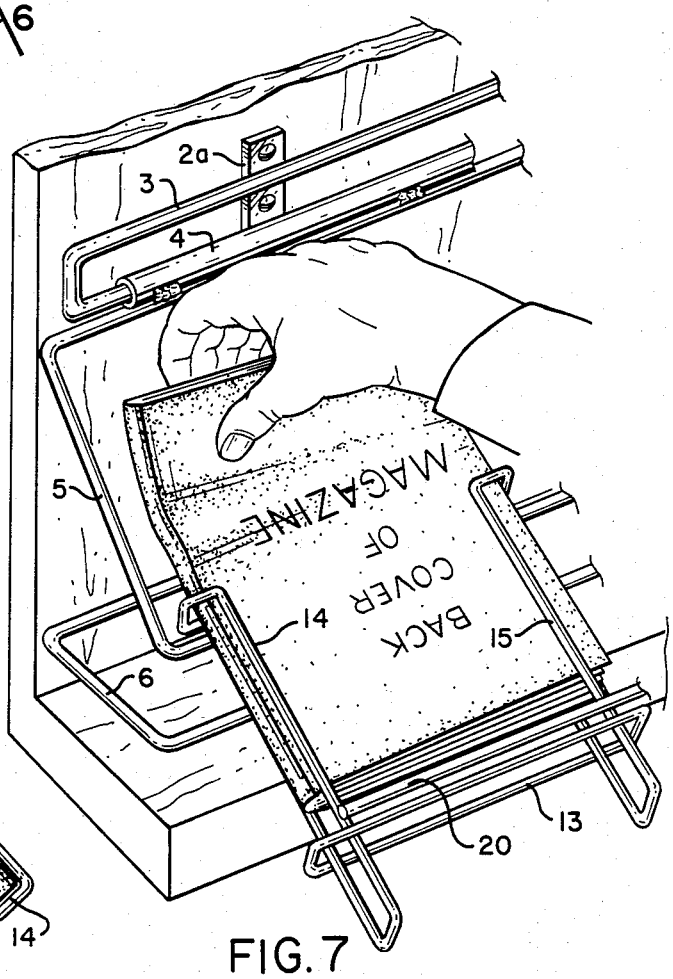
FIG. 7 illustrates in an enlarged view a magazine being inserted in the left magazine cage pivoted outwardly as shown in FIG. 5.

One heavy wire or rod 20 extends across the back of all the magazine cages, as may be viewed more clearly in FIGS. 5 and 6, so that all must be pivoted together from the upright position for display magazines as shown in FIGS. 1 to 4 to a position shown in FIGS. 5 to 7 for loading the magazine cages. FIG. 5 in particular shows how the rod 20 gangs all of the magazine cages together.

Although it is not necessary that the magazine cages be ganged together, it is advantageous to do so in order to make it difficult to remove a magazine by pivoting its cage. This is because when a magazine cage is pivoted out, the magazine which rests on the bottom of the trough-like housing will slide along the bottom and impede further pivoting once the magazine reaches the back corner of the housing, as shown in FIG. 7. It should be noted that the dimension of the trough-like housing from front and rear is just sufficient for a magazine held fully inserted in its cage to clear the rear wall as its cage is pivoted on the upper edge of the front wall. Thus to freely pivot all magazine cages to the position shown in FIG. 5 in order to remove one magazine, as illustrated in FIG. 7, it is necessary to hold all magazines fully inserted in their cages while the ganged cages are pivoted from an upright position to very near an inverted position. It is not difficult to do that with only one magazine in a cage, or even two, but it is difficult to do so for three or four magazines in cages ganged together. This assures some degree of security against removal for the magazines displayed in their cages. To make it even more difficult to pivot the ganged cages, some magazines may be stored in the housing behind one or more cages, such as copies of the displayed magazines in sealed wrappers, although normally copies of the displayed magazines will be stored behind a counter attended by a clerk. If magazines are stored behind the magazine cages, all such stored magazines must then be removed before the ganged magazine cages may be pivoted outwardly. This would further impede anyone from removing a magazine from its cage, and would clearly attract the attention of a clerk if it were attempted.

From the foregoing, it is readily appreciated that the invention is comprised of a plurality of magazine cages pivoted, and preferably ganged to pivot together about the front edge of a trough-like housing. The housing may be made of sheet metal, plastic or wood, but is preferably made of wire as shown to allow debris that may otherwise be accumulated in it to fall through. The cages may also be made of sheet metal, plastic or wood, but again it is preferred to make them of wire as shown for durability, light weight and compatibility in appearance with the wire trough. The trough itself is preferably hinged on a panel to permit sweeping under it, for example, as noted hereinbefore, and all of the magazine cages are preferably ganged together for reasons noted above.

Although particular embodiments of the invention have been described and illustrated herein, it is recognized that modifications and variations may readily occur to those skilled in the art. Consequently, it is intended that the claims be interpreted to cover such modifications and variations.

What is claimed is:

1. A magazine display rack comprised of a trough-like housing having a front wall, a bottom and a rear wall, said rear wall having brackets connected thereto for securing said housing to a display panel or wall, a plurality of magazine cages for securing magazines on display standing upright in said housing against the front wall thereof, each of said cages being closed at the top and open at the bottom, means for pivoting each cage on the upper edge of said front wall to gain access to the open end thereof for insertion or removal of a magazine, the pivot of each cage being at a position between its open and closed ends selected so that in its upright position, a magazine in the cage rests on said bottom of said housing, and the spacing between said front wall and said rear wall being selected so that a magazine held firmly in its cage will just clear the rear wall while its cage is being pivoted outwardly, and an opaque sheet across the front of each cage to screen the cover of a magazine secured therein except that portion thereof bearing the title.

2. A magazine display rack as defined in claim 1 wherein said cages are ganged together.

3. A magazine display rack as defined in claim 2 wherein said magazine cages are each made of wire to permit holding magazines in while pivoting said cages outwardly.

4. A magazine display rack as defined in claim 1 wherein said trough-like housing is made of wires to permit any debris to fall through spaces between wires.

* * * * *